US007867373B2

(12) United States Patent
Van Der Plas et al.

(10) Patent No.: US 7,867,373 B2
(45) Date of Patent: Jan. 11, 2011

(54) METHOD AND APPARATUS FOR THE PRODUCTION OF ALUMINUM

(75) Inventors: Dietrich Willem Van Der Plas, Haarlem (NL); Yanping Xiao, Delft (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 1059 days.

(21) Appl. No.: 11/388,208

(22) Filed: Mar. 24, 2006

(65) Prior Publication Data

US 2006/0226026 A1 Oct. 12, 2006

Related U.S. Application Data

(60) Provisional application No. 60/667,075, filed on Apr. 1, 2005.

(51) Int. Cl.
*C25C 3/00* (2006.01)

(52) U.S. Cl. ..... 205/372; 205/376; 205/392; 205/393; 205/396; 204/243.1

(58) Field of Classification Search ..... 205/372–396; 204/243.1
See application file for complete search history.

(56) References Cited

U.S. PATENT DOCUMENTS 4,265,716 A 5/1981 Loutfy et al.
4,464,234 A 8/1984 Minh et al.
6,565,733 B1 * 5/2003 Sportel et al. ..... 205/372

FOREIGN PATENT DOCUMENTS

| | | |
|---|---|---|
| DE | 3412114 | 10/1985 |
| GB | 23707 | 6/1896 |
| GB | 484014 | 4/1938 |
| WO | 0037691 | 6/2000 |
| WO | 2004088000 | 10/2004 |

OTHER PUBLICATIONS

Hsu et al. Combined aluminium sulphide prodn. and electrolysis to aluminium by reacting alumina with carbonyl sulphide or carbon di:sulphide, Jul. 17, 1984, Derwent Abstract. pp. 1-2.*

(Continued)

*Primary Examiner*—Arun S Phasge
(74) *Attorney, Agent, or Firm*—Novak Druce + Quigg LLP

(57) ABSTRACT

Disclosed is a method for the continuous production of aluminum from alumina including a first step of converting alumina ($Al_2O_3$) into aluminum sulfide ($Al_2S_3$) and a second step of separation of aluminum from aluminum sulfide in a separating reactor. Wherein in the first step in a conversion reactor alumina is dissolved in a molten salt to form a melt and a sulfur containing gas is fed through the melt whereby the sulfur containing gas acts as a reagent to convert at least part of the alumina into aluminum sulfide and at least part of the melt is used in the second step. Further the invention relates to an apparatus for operating the method.

21 Claims, 3 Drawing Sheets

OTHER PUBLICATIONS

Nguyen Q. Minh et al., "The Electrochemical Behavior of $Al_2S_3$ in Molten $MgCl_2$ +NaCl+KCl Eutectic", *J. Electroana. Chem.,* 131 (1982) pp. 229-242.

N.Q. Minh et at., "The Electrolysis of $Al_2S_3$ in $AlCl_3$-$MgCl_2$-NaCl-KCl Melts", *J. Appl. Electrochem.,* vol. 12 (1982) pp. 653-658.

R.O. Loutfy et al., "Potential for Energy Savings in the Production of Aluminum: Aluminum Sulfide Route", Chemical Metallurgy—A Tribute to Carl Wagner, Proc. Of Symp. On Metallurgical Thermodynamics and Electrochemistry at the 110th AIME annual meeting, N.A. Gokcen, Ed., Feb. 1981, The Metallurgical Society of AIME, New York (1981).

U.S. Appl. No. 10/550,678, filed Sep. 26, 2005, Van Der Plas et al.

* cited by examiner

METHOD AND APPARATUS FOR THE PRODUCTION OF ALUMINUM

CROSS-REFERENCE TO RELATED APPLICATION

This claims the benefit of U.S. provisional patent application No. 60/667,075 to Van der Plas et al., filed Apr. 1, 2005, incorporated herein by reference in its entirety.

FIELD OF THE INVENTION

The invention relates to a method for the continuous production of aluminum from alumina comprising a first step of converting alumina ($Al_2O_3$) into aluminum sulfide ($Al_2S_3$) and a second step of separation of aluminum from aluminum sulfide in a separating reactor. Furthermore, the invention relates to an apparatus for operating the method.

BACKGROUND OF THE INVENTION

International publication WO-00/37691, incorporated herein by reference, discloses a method wherein in a first step, also called a sulfidation step, solid alumina is converted into solid aluminum sulfide ($Al_2S_3$) by reacting with gaseous carbon sulfide. In a second step, also called a separation step, the solid aluminum sulfide is fed into a separating reactor such as an electrolysis cell wherein metallic aluminum is separated from the aluminum sulfide.

This has various drawbacks. One such drawback is that it requires two separate processes: the sulfidation step and further the separation step. As a consequence the aluminum sulfide has to be transported from the reactor in which it is formed to the reactor in which the separation step is carried out. Aluminum sulfide has a very high affinity to oxygen. Therefore, any oxygen with which the aluminum sulfide comes into contact, e.g. as oxygen in air or in water, converts the aluminum sulfide back into alumina. The known process therefore puts high demands on the handling of aluminum sulphide.

Another drawback of the disclosed method is that, to perform the separation step of aluminum sulfide efficiently at a low voltage, in particular by electrolysis using inert electrodes, it is required that a large fraction, preferably all, of the alumina is converted in the sulfidation step into aluminum sulfide before the reaction components of the sulfidation step are fed into the electrolysis cell. Alumina present in an electrolysis cell operated at a low voltage is not discomposed and settles in the cell as a sludge, which has to be removed. Removal of sludge disturbs the operation of the electrolysis cell and more importantly, brings about the risk of introducing oxygen into the electrolysis cell, which converts aluminum sulfide back into alumina. Furthermore, the alumina that remains present in the electrolysis cell may dissolve and saturate the electrolyte, thus hindering further dissolution of aluminum sulfide and subsequent separation of aluminum from aluminum sulfide.

However, a nearly complete conversion of alumina into aluminum sulfide reduces the overall efficiency of the process. In practice the conversion rate slows down as the reaction proceeds, and the efficiency of the sulfidation reaction decreases, as the time, the reactor volume, and the amount of sulfidation agents required per unit of aluminum sulfide increase. A further drawback is that compounds from the separation step, in particular alumina, have to be discarded.

SUMMARY OF THE INVENTION

It is an object of the present invention to provide a method for the manufacture of aluminum, in particular primary aluminum, which has a higher efficiency of use of the alumina.

It is another object of the present invention to provide a method for the manufacture of aluminum, in particular primary aluminum, with which a higher conversion of alumina can be achieved.

It is yet another object of the present invention to provide a method for the manufacture of aluminum, in particular primary aluminum, which requires fewer steps, preferably a method with which, the sulfidation and separation steps are at least partly integrated.

It is a further object of the present invention to provide a method for the manufacture of primary aluminum, which avoids or at least reduces the problem associated with the handling of aluminum sulfide.

One or more of these objects are achieved with the method according to the invention for the continuous production of aluminum, in particular primary aluminum, from alumina comprising a first step of converting alumina ($Al_2O_3$) into aluminum sulfide ($Al_2S_3$) and a second step of separation of aluminum from aluminum sulfide in a separating reactor, and wherein the separating apparatus is an electrolysis cell, and wherein in the first step in a conversion reactor alumina is dissolved in a molten salt to form a melt and a sulfur-containing gas is fed through the melt wherein the sulfur containing gas acts as a reagent to convert at least part of the alumina into aluminum sulfide and at least part of the melt is used in the second step, and wherein the melt with the dissolved alumina and the aluminum sulfide is continuously recirculated between the first and the second process step.

For the purpose of this description the term "salt" also comprises a mixture of salts, and the term "sulfur-containing gas" comprises sulfides.

The method according to the invention has one or more of the following advantages.

The aluminum sulfide formed is dissolved in the molten salt and can easily be transported to the second, separation, step. Thus, the handling problem of the prior art method is eliminated or at least reduced.

Another advantage is that the melt, even with an incomplete conversion of alumina into aluminum sulfide, is suitable for a variety of separation processes. Any alumina remaining in the melt after separation can be fed back with the molten salt into the first, conversion, step.

Another advantage is that the process is operated in a continuous or at least semi-continuous fashion, which to a very large extent eliminates yield losses and operating difficulties that are associated with batch type processes or processes that require frequent standstills or maintenance. Examples of the latter include the present Hall-Héroult process for the reduction of alumina into metallic aluminum, which requires regular replacement of the consumable anodes. In the current invention, due to the reduced cell voltage, the carbon electrodes remain inert and can be used for a prolonged time.

Another advantage of the process according to the invention over the known prior art process is related to the thermal imbalance. The known sulfidation process is endothermic and requires heat input. In the separation process, on the other hand, heat is generated by ohmic losses. Integration of the two steps in accordance with the present invention enables a direct input of the heat generated by the separation process into the sulfidation reaction. Reference to the current Hall-Héroult process serves to illustrate this point, namely in modern Hall-Héroult cells, typically about 30% of the energy is dissipated as heat losses in the molten salt. As the bath temperature should remain constant, this heat must be dissipated to the surroundings. Apart from the loss of energy, the Hall-Héroult cell must be designed to dissipate heat, which obstructs more favorable compact cell designs. In the current invention, substantially all the heat that is generated by ohmic losses is absorbed in the conversion from alumina to aluminum, and the cell design can be made much more compact.

Yet another advantage connected with the continuous recycling process is that it is not necessary to convert a considerable amount of alumina into aluminum sulfide. So the time for conversion can be selected such that an optimum can be reached between time for conversion on the one hand and flow of aluminum containing melt back from the separation step into the conversion step on the other hand.

Any alumina that is not converted but fed into the separation step as part of the melt, can be fed back into the conversion step and therefore, does not create a waste flow that may have to be discarded.

A relevant characteristic of the alumina being dissolved in the melt is that any product from the sulfidation reaction is directly available in the melt, which eliminates the need for a separation of the alumina and aluminum sulfide containing species. Another relevant characteristic is that the sulfidation reaction proceeds by direct contact between the sulfidizing gas and the melt. Thus the whole gas/liquid interface is used as a contact area for the sulfidation reaction. This is an important advantage over reactions between a gas and particles dispersed in a melt, where only a small fraction of the gas/liquid interface is occupied by gas/particle contact.

The melt as described herein comprises a mixture of various, complex ions, similar to what is known from the regular Hall-Héroult process for the reduction of alumina. In this melt, $Al_2O_3$ and $Al_2S_3$ need not be present in their molecular form, but also may be present as ionic species that are associated in particular with the dissolution of $Al_2O_3$ and $Al_2S_3$. For simplicity, the words "alumina" and "aluminum sulfide" that are used throughout this description refer to and include these molecular and/or ionic species.

At least part of the melt may be fed to the electrolysis cell where the salt can act as the electrolyte for the electrolysis. The conditions in the electrolysis cell can be selected such that aluminum sulfide is decomposed, thereby separating aluminum, while at the same time not decomposing alumina. The melt in the electrolysis cell is lower in aluminum sulfide content but in practice unchanged in alumina and can be fed back into the conversion reactor.

Further, because of the lower cell voltage needed to decompose aluminum sulfide as compared to the voltage needed to decompose alumina, inert electrodes with a long lifetime can be used.

A feature of the invention is also that at least part of the melt with dissolved aluminum sulfide is fed to the separating reactor and at least part of the melt with dissolved reaction products from the step of separation in the separating reactor is fed into the conversion reactor. At least part of the melt from the conversion reactor is fed to the separating reactor, and at least part of the melt in the separating reactor is fed back into the conversion reactor, wherein feeding and feeding back is done in a continuous process.

An advantage is that the operating conditions in both the conversion reactor and in the separating reactor do not, or only to a small extent, vary in time. In the conversion reactor and in the separating reactor optimum conditions can be selected. Also, there is no need to aim at a full conversion of alumina into aluminum sulfide or a full separation of alumina from the aluminum sulfide. The method according to the invention is therefore carried out as a continuous process. Conversely, the prior art process is a batch process. In the first step, all alumina should be converted into aluminum sulfide, which is then batch-wise fed into the separating apparatus. In particular when the separation takes place in an electrolysis cell, the batch-wise addition of aluminum sulfide disturbs the electrolysis and changes the operating condition of the cell.

An embodiment of the method of the invention is characterized in that the separating apparatus is a multi-pole electrolysis cell.

As the anode is not consumed in the electrolysis of aluminum sulfide, a multi-polar cell can be used which incorporates a series of anodes and cathodes in one single cell. An advantage is a far more compact cell design, thus reducing investment and operational costs. A second advantage is a reduction of ohmic losses, thus contributing to the energy efficiency of the process.

In a further embodiment according to the invention the electrolysis cell has a compact design and any heat dissipation to the surroundings is minimized in order to use substantially all of the enthalpy from the ohmic losses as energy input to the sulfidation step.

A further embodiment of the method according to the invention is characterized in that the first step and the second step are performed or carried out in a reactor vessel operating as a single reactor.

In this embodiment the method of the invention can be carried out in a compact reactor which requires less volume and is less costly, both in construction and in operation, then separate reactors for steps one and two. Also, transport problems as mentioned before are further mitigated.

A further advantage can be obtained in energy consumption. The conversion of alumina into aluminum sulfide is an endothermic reaction. The separation of alumina from aluminum sulfide, in particular in an electrolysis cell is connected with heat generation through energy dissipation in the electrolyte.

By supplying this generated heat to the conversion step, a high energy efficiency can be achieved. This is particularly so when at least part of the melt is made to circulate between the two steps using two reactors or a single integrated reactor.

In an embodiment, the sulfur containing gas is substantially carbon disulfide ($CS_2$).

Another embodiment of the method of the invention is characterized in that the molten salt substantially comprises chloride salts, and preferably a mixture of NaCl and KCl. In particular NaCl and KCl are relatively inexpensive, its mixture, more in particular the eutectic composition, has a suitable melting point, a low vapor pressure in the proposed operational window of the process, and they are harmless under regular operating conditions.

Preferably the composition of the molten salt comprises in the range of between 30 and 70 wt. % NaCl and in the range of between 70 and 30 wt. % KCl.

A further embodiment of the method of the invention is characterized in that the melt of salt comprises a fluorine containing compound.

The suitable fluorine containing compound may include one or more compounds having a molecular formula $Na_aAlF_{a+3}$ and/or $K_aAlF_{a+3}$ ("a" being an integer equal to a greater than 1), such as $NaAlF_4$, $Na_2AlF_5$ and $Na_3AlF_6$, and $KAlF_4$, $K_2AlF_5$ and $K_3AlF_6$. The fluorine compound may include one or more of: a simple mixture of NaF or $AlF_3$, a simple mixture of KF or $KF_3$, a eutectic mixture of NaF and $AlF_3$, a eutectic mixture of KF and $KF_3$, and a certain complex such as sodium fluoroaluminate or potassium fluoroaluminate. Any one of these fluxes may be selected, though two or more of them may be added in combination.

In a preferred embodiment, fused sodium aluminum fluoride, commonly called cryolite, or a mixture of cryolite and other fluorides is used.

Tests have shown that addition of fluorine containing compounds, such as cryolite, to the molten salt has a very beneficial effect on the current density in an electrolyses cell at a given cell potential. An increase of a factor three or more as compared to a molten salt without cryolite, is achievable.

Although not intended to be bound to any particular mechanism, it is assumed that, for an efficient conversion of alumina into aluminum sulfide, carbon and sulfur are required as reactants. Carbon disulfide contains both these elements and its manufacture and processing is based on proven technology. Furthermore, carbon disulfide is a gas at the operational conditions, thus facilitating the contact between the reactants. Carbon disulfide is also a compound that is substantially free of oxygen, as required for a good conversion as explained above.

Preferably the melt of salt is substantially free of alkaline earth metals or compounds thereof.

It has been shown that alkaline earth metals have a good affinity to sulfur and form sulfides before aluminum sulfides can form. Therefore earth alkaline metals have a detrimental effect on the efficiency of the sulfide containing gas.

Preferably the conversion reactor is a bubble column wherein the sulfide containing gas is fed into the lower portion thereof thereby forming bubbles which rise in the bubble column.

Bubble columns per se are known in the process industry. They have the advantage of being based on a proven technology and they can be manufactured in an embodiment suitable for the method of the invention.

An advantageous embodiment of the method according to the invention is characterized in that the bubbles rising in the bubble column are used to transport at least part of the aluminum sulfide containing melt to the separating apparatus.

Bubbles rising up in the bubble column lift molten salt with aluminum sulfide dissolved therein. This lifting action can be used to transport aluminum sulfide from the bubble column to the separating reactor, thereby saving energy and reducing complexity of the total plant for the production of primary aluminum.

In a preferred embodiment the bubbles rising in the bubble column are used to provide at least part of the driving force to recirculate the melt between the sulfidation and separation stages.

Yet another embodiment of the method according to the invention is characterized in that the conversion of alumina into aluminum sulfide is carried out at a temperature in a range of between 700° C. and 1100° C., preferably in a range of between 800° C. and 1000° C., more preferably in a range of between 800° C. and 900° C.

Tests have shown that the conversion of alumina into aluminum sulfide proceeds faster at higher temperature. However, it has also been found that for an efficient conversion γ-alumina is being preferred. At temperature above about 1100° C., γ-alumina transforms to α-alumina at a high rate. Therefore the temperature at which the conversion is carried out is preferably chosen below about 1100° C., more preferably below about 1000° C. and even more preferably below about 900° C.

On the other hand, to have a sufficiently high conversion rate, the temperature at which the conversion is done is preferably chosen above about 700° C., more preferably above 800° C.

Preferably the sulfidation process is carried out at a pressure above atmospheric pressure, preferably at a pressure above 2 bar, and more preferably at a pressure of 3 bar or more.

Tests have shown that the conversion rate of alumina into aluminum sulfide increases with the partial pressure of the sulfide containing gas.

Therefore it is preferred to execute the method at above atmosphere pressure in the conversion reactor.

The invention is also embodied in an apparatus for carrying out the method according to the invention and comprising a bubble column suitable for converting alumina into aluminum sulfide by a gaseous sulfur containing compound, feeding means for feeding the gaseous sulfur containing compound into the bottom portion of the bubble column, an electrolysis cell, a first connecting duct between the top portion of the bubble column and the electrolysis cell and a second connecting duct between the lower portion of the bubble column and the electrolysis cell.

A bubble column is a well-known reactor vessel embodying proven technology and suitable for reactions between a melt and a gaseous reactant. Advantageously, use can be made of the lifting effect of the rising bubbles to convey aluminum sulfide to the electrolysis cell. For transport of molten salt from the bubble column to the electrolysis cell and in reverse direction, ducts are provided. It is noted that the ducts can be part of the two reactors, bubble column and the electrolysis cell, whereby these two reactors are then integrated into a single reactor.

BRIEF DESCRIPTION OF THE DRAWINGS

The invention will now be illustrated with reference to a non-limiting embodiment according to the drawings in which.

DETAILED DESCRIPTION OF THE PREFERRED EMBODIMENTS

Figure 1:
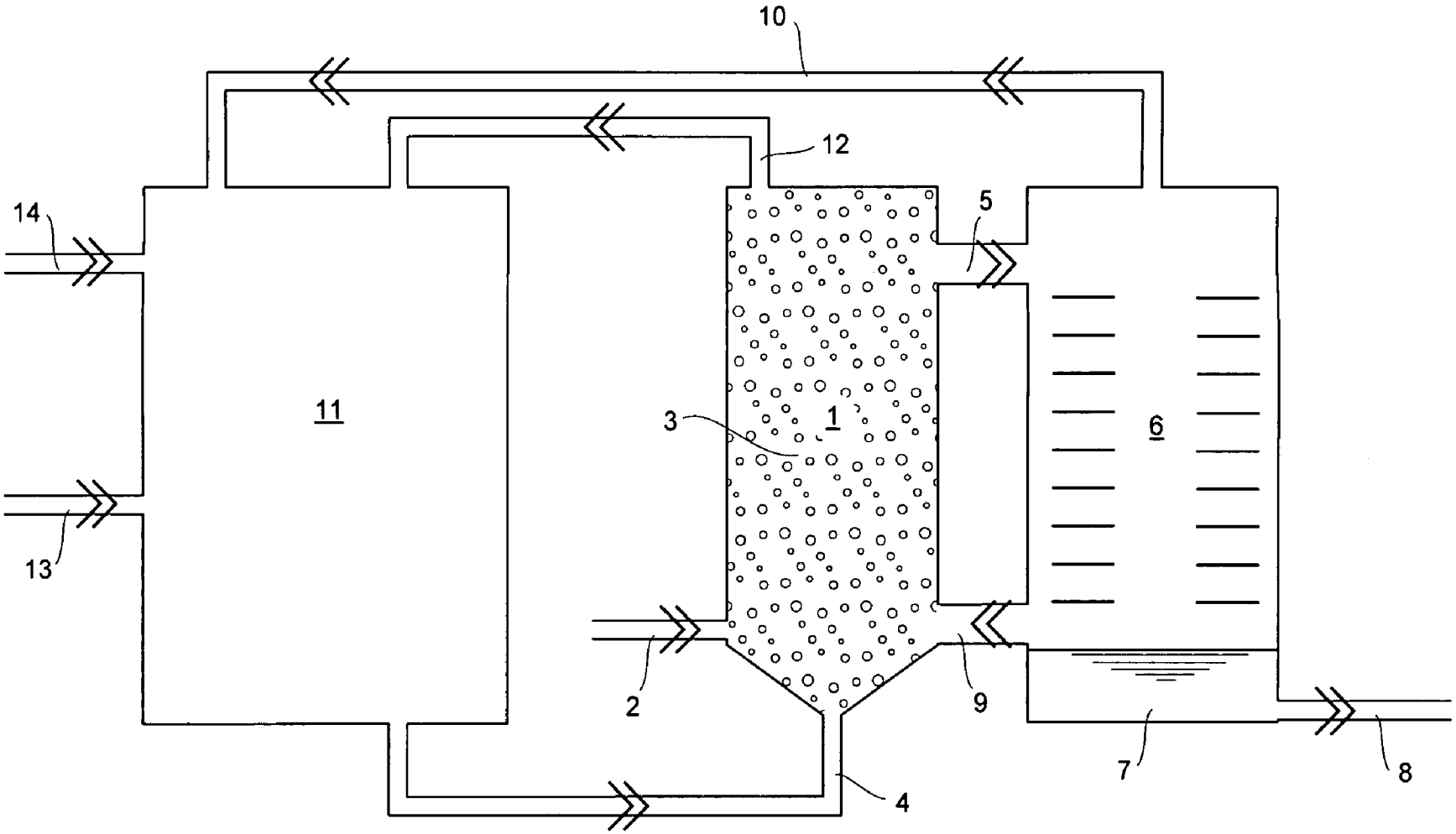
FIG. 1 shows a basic diagram of an apparatus for the production of aluminum for alumina according to the invention.

In FIG. 1 reference number 1 refers to a conversion reactor, preferably in the form of a bubble column. Alumina is fed into the conversion reactor through alumina supply line 2. The conversion reactor 1 contains a bath 3 of molten salt. Through supply line 4 a sulfur and carbon containing gas, such as $CS_2$, is fed to the bottom portion of the conversion reactor 1. In the conversion reactor, alumina is dissolved in the molten salt and converted into aluminum sulfide.

A two phase flow of bubbles, containing gaseous reagents and reaction products, dispersed in a liquid containing the molten salt, aluminum sulfide and unconverted alumina, rises in the conversion reactor 1 and lifts the liquid to the first transfer duct 5 through which the components are conveyed to the separating reactor 6, here in the form of a multi-pole electrolysis cell. In the multi-pole electrolysis cell, aluminum sulfide is decomposed into molten aluminum and gaseous sulfur. A bath of molten aluminum 7 is formed, which can be tapped off through tapping line 8. As the liquid is transported to the first transfer duct 5 by the gas lift in the bubble column, a similar amount of liquid is entrained from the second transfer duct 9. Thus the gas lift in the bubble column provides a driving force for the recirculation of the melt between the sulfidation and the separation reactor. Thus no external agents like pumps may be required.

Components present in the separating reactor 6 are fed back into the conversion reactor 1 through the second transfer duct 9. The components fed back into the conversion reactor may still contain alumina and not yet decomposed aluminum sulfide.

Conversion reactor 1, first transfer duct 5, separating reactor 6 and second transfer duct 9 from a closed loop system in which molten salt, alumina and aluminum sulfide circulate. First transfer duct 5 and second transfer duct 9 may be constructed such that they form part of one or both of the reactors leading to a single reactor in which both steps, conversion and separating, take place.

Gaseous sulfur from the separation step is fed back through sulfur return line 10 to the carbon disulfide plant 11. To this carbon disulfide plant 11 also reaction products or unreacted reactants from the conversion process, such as COS, $CS_2$ and $S_2$ are fed back through feed back line 12.

Make-up sulfur is fed to the carbon disulfide plant 11 through sulfur supply line 13; a carbon containing reactant, such as natural gas is fed to the carbon disulfide plant 11 through carbon supply line 14.

Through the energy, dissipated in the electrolysis cell, the components therein rise in temperature, such that the flow of components through the second transfer duct 9 have a higher temperature than the components conveyed through first transfer duct 5. As a typical value, a temperature rise from 790° C. to 800° C. can be mentioned.

This extra sensible heat can be used for the endothermic conversion of alumina into aluminum sulfide.

The components flowing through the first transfer duct 5 are high in aluminum sulfide, the components flowing through the second transfer duct 9 are low in aluminum sulfide.

EXAMPLES

Figure 2:
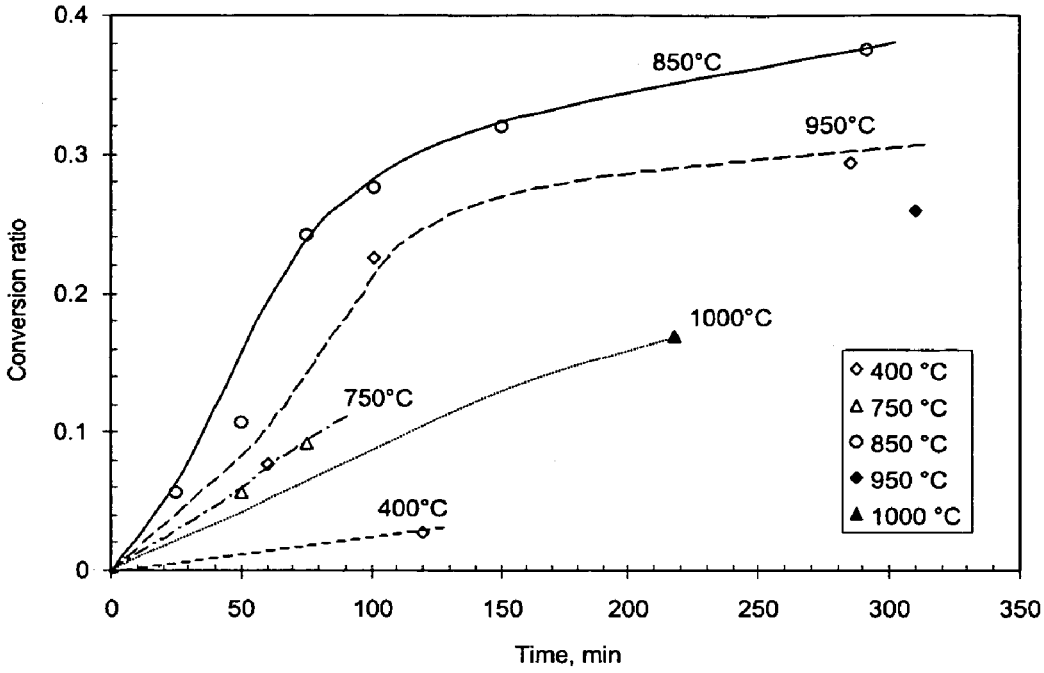
FIG. 2 shows the decrease of the reaction rate as conversion proceeds according to the prior art.

FIG. 2 shows the effect of reaction time of the conversion rate for the sulfidation process according to the prior art disclosed in WO-00/37691. It is observed that the reaction rate slows down as conversion proceeds. Thus, the known process becomes less efficient for a high conversion ratio, while at the same time, a full conversion is desired for the subsequent separation process.

Figure 3:
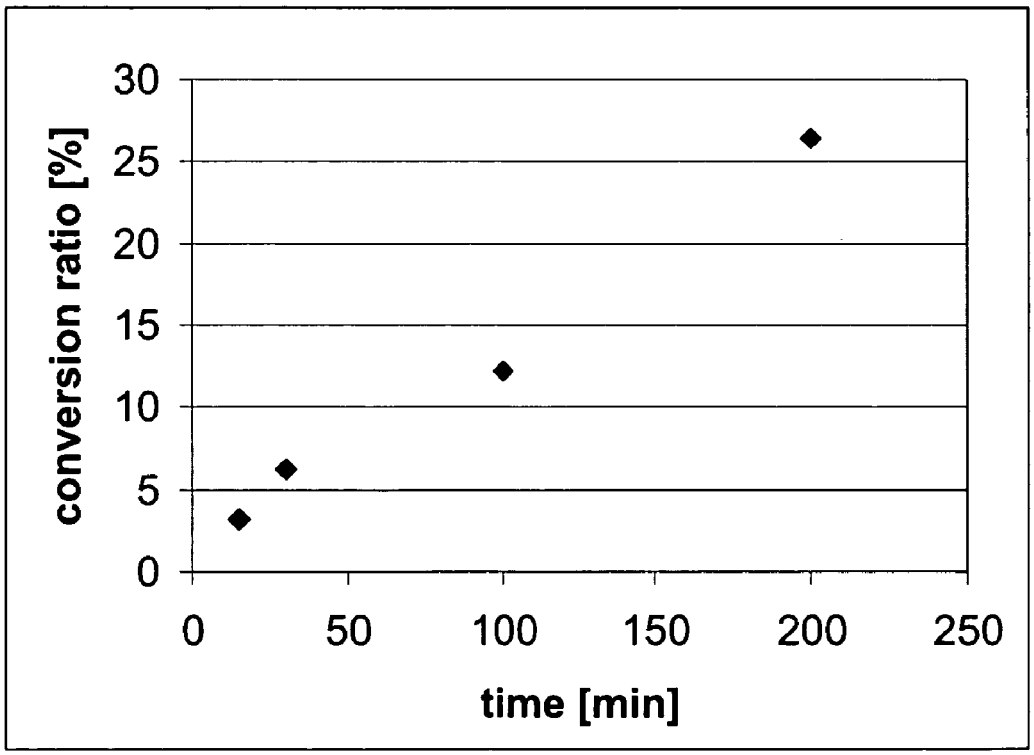
FIG. 3 shows the effect of the reaction time on the conversion rate according to the present invention.

FIG. 3 shows the effect of the reaction time on the conversion ratio in a method according to the invention.

In this experiment gamma alumina was added to a salt mixture containing a eutectic composition of NaCl and KCl, and to which 10 wt. % of cryolite was added. The salt mixture was preheated to 850° C. under argon atmosphere, and at t=0 a mixture of argon and $CS_2$ was supplied through a tube injected into the salt mixture from the top. The experiment was carried out at atmospheric pressure, the $CS_2$ partial pressure being about 0.70 bar. As can be seen, increase of reaction time has a positive effect on the conversion ratio. However, the conversion rate (amount of alumina converted per unit of time) remains substantially constant. This facilitates the tuning of the process towards its most efficient operational window, and reduces possible transient effects that may occur, for instance, during start up or as a consequence of changes in the alumina content of the melt.

Figure 4:
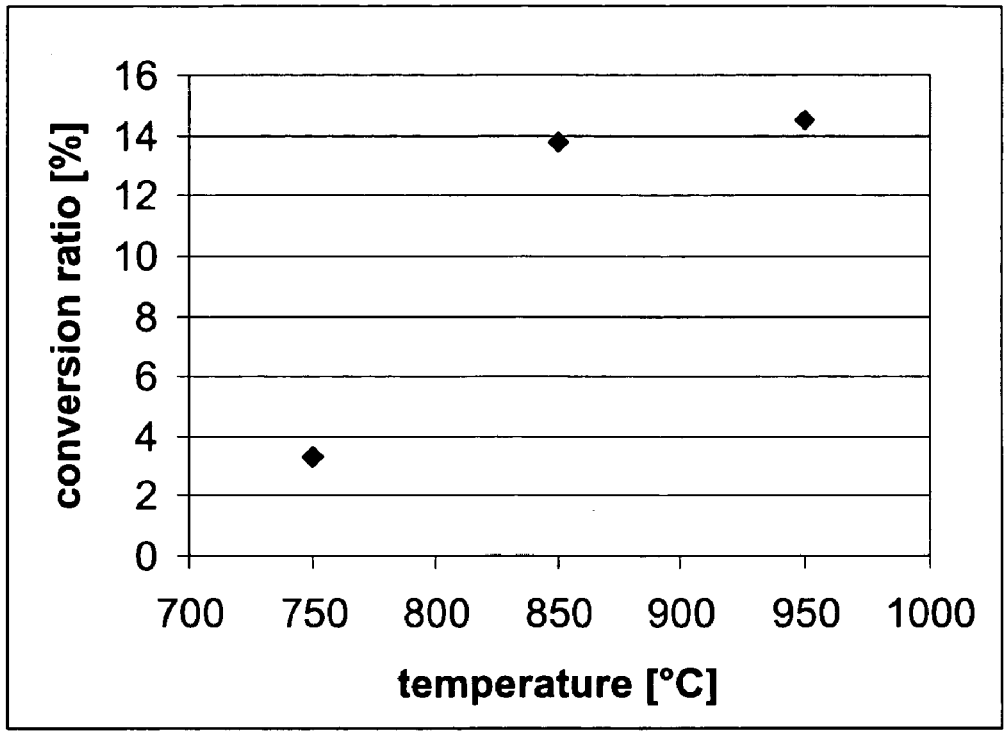
FIG. 4 shows the effect of the temperature in the conversion reactor on the conversion rate.

FIG. 4 shows the measured effect of the temperature on the conversion ratio after 100 minutes. Apart from the temperature, all experimental conditions were identical to those described with FIG. 2. These measurements show that the temperature in the conversion reactor preferably lies in the range between about 800° C. and about 1000° C.

Figure 5:
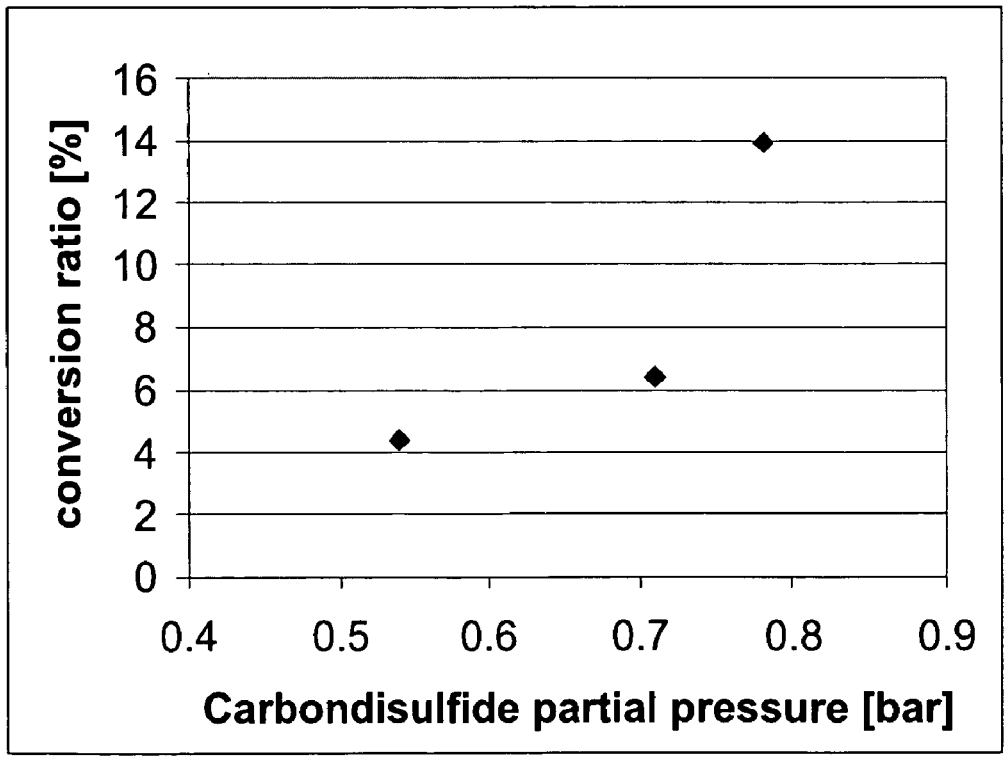
FIG. 5 shows the effect of the partial pressure of carbon disulfide on the conversion rate.

FIG. 5 shows the effect of the partial pressure of carbon disulfide in the conversion reactor on the conversion rates after 100 minutes. Apart from the $CS_2$ partial pressure, all experimental conditions were identical to those described with FIG. 2. This graph shows that considerable advantages can be achieved by operating the conversion reactor at a pressure above atmospheric pressure.

Having now fully described the invention, it will be apparent to one of ordinary skill in the art that many changes and modifications can be made without departing from the spirit or scope of the invention as herein described.

The invention claimed is:

1. Method for the continuous production of aluminum from alumina, the method comprising:

a first step of converting alumina ($Al_2O_3$) into aluminum sulfide ($Al_2S_3$) in a conversion reactor comprising a bubble column, and a second step of separation of aluminum from aluminum sulfide in a separating reactor comprising an electrolysis cell, wherein the second step is performed in the electrolysis cell, wherein in the first step in the bubble column alumina is dissolved in a molten salt to form a melt and a sulfur containing gas is fed through the melt, wherein the sulfur containing gas acts as a reagent to convert at least part of the alumina into aluminum sulfide and at least part of the melt is used in the second step, wherein the melt with the dissolved alumina and the aluminum sulfide is continuously recirculated between the first and the second process step, and wherein the first step and the second step are performed in a reactor vessel operating as a single reactor, the melt produced by the first step from the bubble column is fed to the electrolysis cell through a first connecting duct between a top portion of the bubble column and a top portion of the electrolysis cell, and the melt with the dissolved alumina and the aluminum sulfide is recirculated from the electrolysis cell to the bubble column through a second connecting duct between a lower portion of the bubble column and a lower portion of the electrolysis cell, and wherein bubbles rising in the bubble column lift molten salt with aluminum sulfide dissolved therein to transport at least part of the aluminum sulfide containing molten salt to the separating reactor.

2. Method according to claim 1, wherein the separating reactor is a multi-pole electrolysis cell.

3. Method according to claim 1, wherein the sulfur containing gas is substantially carbon disulfide.

4. Method according to claim 1, wherein the molten salt substantially comprises chloride salts.

5. Method according to claim 1, wherein the molten salt substantially comprises a mixture of NaCl and KCl.

6. Method according to claim 1, wherein the melt of salt comprises a fluorine containing compound.

7. Method according to claim 1, wherein the melt of salt comprises cryolite.

8. Method according to claim 1, wherein the melt of salt is substantially free of alkaline earth metals or compounds thereof.

9. Method according to claim 1, wherein the conversion reactor comprises a bubble column, wherein the sulfide containing gas is fed into the lower portion of the bubble column thereby forming bubbles which rise in the bubble column.

10. Method according to claim 9, wherein the bubbles rising in the bubble column are used to transport at least part of the aluminum sulfide containing melt to the separating reactor.

11. Method according to claim 10, wherein the bubbles rising in the bubble column are used to provide at least part of the driving force to recirculate the melt between the sulfidation and separation stages.

12. Method according to claim 1, wherein the conversion of alumina into aluminum sulfide is carried out at a temperature in a range of between 700° C. and 1100° C.

13. Method according to claim 1, wherein the conversion of alumina into aluminum sulfide is carried out at a temperature in a range of between 800° C. and 1000° C.

14. Method according to claim 1, wherein the conversion of alumina into aluminum sulfide is carried out at a temperature in a range of between 800° C. and 900° C.

15. Method according to claim 1, wherein the sulfidation process is carried out at a pressure above atmospheric pressure.

16. Method according to claim 1, wherein the sulfidation process is carried out at a pressure of 3 bar or more.

17. Method according to claim 1, wherein the molten salt substantially comprises a mixture of NaCl, KCl and cryolite.

18. The method of claim 1, wherein heat generated in the separating reactor is directly input into the conversion reactor by continuously recirculating the aluminum sulfide containing molten salt between the conversion reactor and the separating reactor.

19. The method according to claim 18, wherein substantially all heat generated by ohmic losses in the separating reactor is absorbed in the conversion from alumina to aluminum sulfide in the conversion reactor.

20. Apparatus for continuous production of aluminum from alumina, comprising:

a conversion reactor for performing a first step of converting alumina ($Al_2O_3$) into aluminum sulfide ($Al_2S_3$), and a separating reactor for performing a second step of separation of aluminum from aluminum sulfide, wherein in the first step in the conversion reactor alumina is dissolved in a molten salt to form a melt and a sulfur containing gas is fed through the melt, wherein in the first step the sulfur containing gas acts as a reagent to convert at least part of the alumina into aluminum sulfide and at least part of the melt is used in the second step, wherein the separating is reactor comprises a electrolysis cell, the conversion reactor comprises a bubble column for converting alumina dissolved in the melt into aluminum sulfide by contacting the alumina with the sulfur containing gas comprising a gaseous sulfur containing compound and causing bubbles rising in the bubble column to transport at least part of the aluminum sulfide containing melt to the separating reactor, a feeder for feeding the gaseous sulfur containing compound into the bottom portion of the bubble column, a first connecting duct is between a top portion of the bubble column and a top portion of the electrolysis cell for feeding the melt produced by the first step from the bubble column to the electrolysis cell, and a second connecting duct is between a lower portion of the bubble column and a lower portion of the electrolysis cell for continuously recirculating the melt with the dissolved alumina and the aluminum sulfide from the electrolysis cell to the bubble column.

21. Apparatus according to claim 20, wherein the apparatus is configured for the first step and the second step to be performed in a reactor vessel operating as a single reactor.

* * * * *